US005997694A

United States Patent [19]

Schiel et al.

[11] Patent Number: 5,997,694

[45] Date of Patent: Dec. 7, 1999

[54] PRESS ARRANGEMENT WITH LEVER ARM TO MOVE PRESS SHOE

[75] Inventors: Christian Schiel, Murnau; Wolfgang Schuwerk, Kisslegg; Joachim Grabscheid, Heuchlingen; Rudolf Hasenfuss, Herbrechtingen, all of Germany

[73] Assignee: Voith Sulzer Papiermaschinen GmbH, Heidenheim, Germany

[21] Appl. No.: 08/905,739

[22] Filed: Aug. 4, 1997

[30] Foreign Application Priority Data

Aug. 5, 1996 [DE] Germany ..... 196 31 638

[51] Int. Cl.[6] ..... D21F 3/02

[52] U.S. Cl. ..... 162/358.3; 100/153; 162/361

[58] Field of Search ..... 162/358.3, 361, 162/205; 100/153

[56] References Cited

U.S. PATENT DOCUMENTS

| | | | |
|---|---|---|---|
| 4,713,147 | 12/1987 | Saarinen | 162/358.3 |
| 4,917,768 | 4/1990 | Iimarinen et al. | 162/358.3 |
| 5,167,768 | 12/1992 | Cronin et al. | 162/358.3 |
| 5,676,799 | 10/1997 | Meschenmoser et al. | 162/358.3 |

FOREIGN PATENT DOCUMENTS

| | | | |
|---|---|---|---|
| 218918 | 2/1985 | Germany | 162/358.3 |
| 4344165 | 6/1995 | Germany . | |
| 4409316 | 6/1995 | Germany . | |
| 4425915 | 2/1996 | Germany . | |
| 929773 | 5/1982 | U.S.S.R. | 162/358.3 |

*Primary Examiner*—Karen M. Hastings
*Attorney, Agent, or Firm*—Greenblum & Bernstein, P.L.C.

[57] ABSTRACT

A press arrangement of a paper or cardboard machine for the treatment of a fibrous pulp sheet in a press opening that is extended in the run direction of the fibrous pulp sheet. The press opening is defined by two press surfaces, at least one of which is constructed of a flexible press sleeve that is guided over at least one press shoe. The flexible press sleeve is further able to press against the opposing press surface with the aid of the press shoe due to the creation of a fluid cushion between the press shoe and the press sleeve. The press shoe is thus able to be tensioned such that a resulting main press force is exerted in a direction that runs substantially perpendicular to the fibrous pulp sheet being guided through the press opening. A lever is designed to load the press shoe with an positive or negative force that acts on the press shoe substantially perpendicular to the resulting main press force. The additional positive or negative forces transfer a tilting moment to the press shoe whereby the press shoe tilts around a respective tilting axis. The tilting axis extends substantially perpendicular to the run direction of the fibrous pulp sheet and in the transverse direction of the press arrangement. Thus, the additional forces can, substantially, independently influence the pressure profile in the press opening, set along the run direction of the fibrous pulp sheet.

35 Claims, 2 Drawing Sheets

PRESS ARRANGEMENT WITH LEVER ARM TO MOVE PRESS SHOE

CROSS-REFERENCE TO RELATED APPLICATION

The present application claims priority under 35 U.S.C. 119 of German Patent Application No. 196 31 638.3 filed Aug. 5, 1996, the disclosure of which is expressly incorporated by reference herein in its entirety.

BACKGROUND OF THE INVENTION

1. Field of the Invention

The present invention relates to a press arrangement of a paper or carton machine for the treatment of a fibrous pulp sheet in a press opening.

2. Background of the Invention

Typically, the press opening of a press arrangement extends in the run direction of the fibrous pulp sheet and is defined by two press surfaces. It is known to have at least one of the press surfaces constructed of a flexible press sleeve that is guided over a press shoe, such that a resulting main press force, acting in one direction, is exerted. The resulting main press force is directed essentially perpendicular to the fibrous pulp sheet that is being guided through the press opening.

In a press arrangement of this type, the pressure force profile that is established in the press opening and along the run direction of the fibro is determined by the given relative shape of the press shoe and the suitable hydraulic arrangements located on the opposing press surface.

It is generally known to exert an additional force on the press shoe with the aid of additional pistons on the entrance or exit side, i.e. outside the main target area. The additional pistons supply the press shoe with increased pressure force on the entrance or exit side, causing the pressure profile to tilt and causing a corresponding increase in pressure force.

It is possible to compensate for the effect of the additional forces by employing technical control measures for the main loading force. This process, however, is disadvantageous because it is associated with significant expense and risk respecting possible disturbances impairing the functional safety of the press arrangement. Thus, the productivity of the paper machine facility may be adversely affected.

SUMMARY OF THE INVENTION

The present invention overcomes the above-noted defects and disadvantages of the prior art by improving the press arrangement. The present invention provides for selectively affecting the pressure profile without impacting the resulting main press force. Thus, the technical control measures referred to above are unnecessary and can be avoided, ensuring a simple construction and high functional safety.

The task is solved by the present invention which includes the ability to load the press shoe with additional positive or negative forces that act on the press shoe substantially perpendicular to the resulting main press force. The additional positive or negative force causes a tilting moment around a respective tilting axis of the press shoe. The tilting axis extends essentially perpendicular to the run direction of the fibrous pulp sheet and in the transverse direction of the press arrangement. Thus, with the aid of the additional forces, the press shoe may perform small tilting motions and the pressure profile established within the press opening along the run direction of the fibrous pulp sheet may be influenced substantially independently of the resulting main press force.

The pressure units are designed to allow the press shoe to be capable of tilting. The details of this aspect of the press arrangement do not form part of the present invention and thus will not be described in great detail herein.

Due to this construction, it is possible, in a simple way and without requiring that the press shoe be shifted in the direction of the central loading point of the press point, to selectively affect the pressure profile of the press opening only in the run direction of the fibrous pulp sheet. And, importantly, the profile tilting, caused by the additional force, has practically no effect on the resulting main press force because the additional forces on the press shoe act substantially only perpendicular to the resulting main press force. Thus, the additional force transfers a tilting moment to the press shoe. The tilting moment may be between ±200 kN/m, and preferably between ±100 kN/m.

The pressure profile and the resulting main pressure force can, thus, be adjusted independently of each other. Moreover, the press shoe can execute small tilting moments that, together with the variable height of the press shoe, allow for an adjustment of the shoe position relative to the position of the opposing pressure surface. The respective profile tilting can be executed practically independent of, and without affecting, the resulting main press force. Moreover, the profile tilting can, if necessary, be easily discontinued, as might be necessary during a disruption in operation. Thus, operation can, if needed, be continued in the normal setting. The present invention is further advantaged in that the devices designed for the additional loading of the press shoe can, if needed, be refitted with a minimal effort and without larger reconstructions. Further, these devices can, if needed, be easily dismantled.

In one embodiment of the present invention, the press arrangement includes additional devices designed for the loading of the press shoe that include at least one lever that is connected with the press shoe. The lever is used to transfer the positive or negative additional force to the press shoe. Preferably, this lever extends substantially perpendicular to the run direction of the fibrous pulp sheet and parallel to the resulting main press force.

The device further includes a force unit assigned to the lever for creating the additional positive or negative force on the press shoe. The lever end that points away from the shoe press is loaded by this force unit. The force unit directs a force substantially parallel to the run direction of the fibrous pulp sheet. The lever extends substantially perpendicular to the run direction of the fibrous pulp sheet and parallel to the resulting main press force. The lever is loaded substantially vertically to cause the respective tilting moment on the press shoe.

Preferably, in the present invention, the force unit is assembled such that it engages the lever. Further, in accordance with another feature of the present invention, the force unit may be positioned so that it is supported so that shifting the press shoe occurs with as little obstruction as possible.

A particularly compact construction ofthe press arrangement is achieved by arranging the lever and the designated force unit within the flexible press sleeve. The flexible press sleeve forms the roller sleeve of the press roller, thus, the lever and designated force unit are located within the press roller.

Preferably, in one embodiment of the invention, the force unit assigned to the lever is supported by a stationary support. The stationary support is positioned inside the press roller, around which the roller sleeve circulates. At least one additional force unit is supported by the stationary support.

This additional force unit pressurizes the press shoe and creates the resulting main press force that extends substantially perpendicular to the run direction of the fibrous pulp sheet. The lever and associated force unit can thus be positioned in a particular area within the stationary support.

In accordance with another feature of the present invention, the force unit assigned to the lever can consist of several conventional units known in the art, including, for example, a spring bellows, particularly, an air bellows. It is further conceivable to assign to the lever, as a force unit, at least one magnetic unit.

In accordance with still another feature of the present invention, the force unit assigned to the lever may be a hydraulic or pneumatic cylinder-piston unit. In this particular embodiment, the double action cylinder-piston unit is advantageous because the forces can be applied in both directions, thus creating a tilting moment in both directions. In particular, pneumatic cylinders are advantageous because the arrangement results in a increased flexibility, which is particularly beneficial when the press arrangement runs unevenly due to, for example, the occasional occurrence of paper clots or a faulty run of the mating roller.

In accordance with another feature of the present invention, it may be particularly advantageous to position a gas accumulator either before or after the units, particularly when using the hydraulic cylinder-piston units. Further, it may be useful to position appropriate dampers between the cylinder and the gas accumulator to dampen the throttle.

In another embodiment of the invention, the pressure unit that loads the lever can include an eccentric cam or eccentric shaft. In this case, the free end of the lever is designed in the shape of a fork with two prongs. The eccentric cam or the eccentric shaft engages the lever within the prongs of the fork-shaped end of the lever. Thus, depending on the angle positioning or rotational direction of the eccentric cam or the eccentric shaft, the lever can be selectively maneuvered in an efficient manner in either of two opposing directions. The opposing directions run substantially parallel to the run direction of the fibrous pulp sheet and perpendicular to the resulting main press force.

Preferably, the fork shape of the free end of the lever extends essentially perpendicular to the run direction of the fibrous pulp sheet and parallel to the resulting main press force. This allows the main press force to shift the press shoe with the least number of impediments.

In accordance with another feature of the invention, the eccentric cam or eccentric shaft may be driven by an adjustable motor that includes a self-locking gear assembly. It would be obvious to one skilled in the art to have the driver of the eccentric cam or eccentric shaft placed on the inside of the press roller.

The lever is preferably designed to be somewhat elastic because other mechanical solutions tend to act rigidly on the press shoe. Accordingly, the lever is constructed to be correspondingly thin or the lever is constructed out of an elastic material.

In accordance with a further feature of the present invention, the devices that are designed to load the press shoe with additional force consist of a number of units. The units are spaced across the press arrangement and positioned perpendicular to the run direction of the fibrous pulp sheet. Thus, the press shoe is pressed over the entire width of the press arrangement, as is preferable for influencing the pressure profile. Specifically, individual units can each load the press shoe in the assigned zones, resulting in a cumulative effect on the pressure profile. The cumulative effect on the pressure profile is particularly easily accomplished when using cylinder-piston units as the device. A further advantage arises from using this preferred embodiment. After the pressure profile affects the dry content of the produced fibrous pulp sheet, an automatic drying profile control can also be performed over the width of the sheet.

Another way of expressing the invention is a press arrangement to be used in a paper or cardboard machine that includes a press opening wherein a fibrous pulp sheet is treated and guided in a run direction. The press opening extends in said run direction of said fibrous pulp. A first press roller that further includes a first press surface which further includes a flexible press sleeve.

The press arrangement further includes a second press roller that includes a second press surface. The first and second press surfaces define the press opening. The press arrangement further includes a press shoe pressing the first press surface and whereby the first press surface is guided over the press shoe and presses the second press surface. Thus, the press shoe is stressed such that a resulting main press force is exerted in a direction that is essentially perpendicular to the fibrous pulp sheet that is guided through the press opening.

The press arrangement further includes a pressure unit pressing the press shoe and a device to load the press shoe with additional positive or negative force, transferring a tilting moment to the press shoe thereby tilting the press shoe around a tilting axis. The tilting axis extends essentially perpendicular to the run direction of the fibrous pulp sheet. The positive or negative force acts essentially independent of and perpendicular to the main press force.

The force unit can be selected from a group consisting of spring bellows, air bellows, magnetic unit, hydraulic cylinder-piston unit, pneumatic cylinder-piston unit, double action cylinder-piston unit, eccentric cam and eccentric shaft.

Other useful embodiments and advantages of the present invention may be ascertained by reviewing the present disclosure and the accompanying drawings.

BRIEF DESCRIPTION OF THE DRAWINGS

The invention will be better understood by referring to the description which follows with reference to the drawings, which illustrate by way of non-limiting examples, embodiments of the invention, with like reference numbers representing similar parts throughout the several views, and wherein.

DETAILED DESCRIPTION OF THE DRAWINGS

Figure 2:
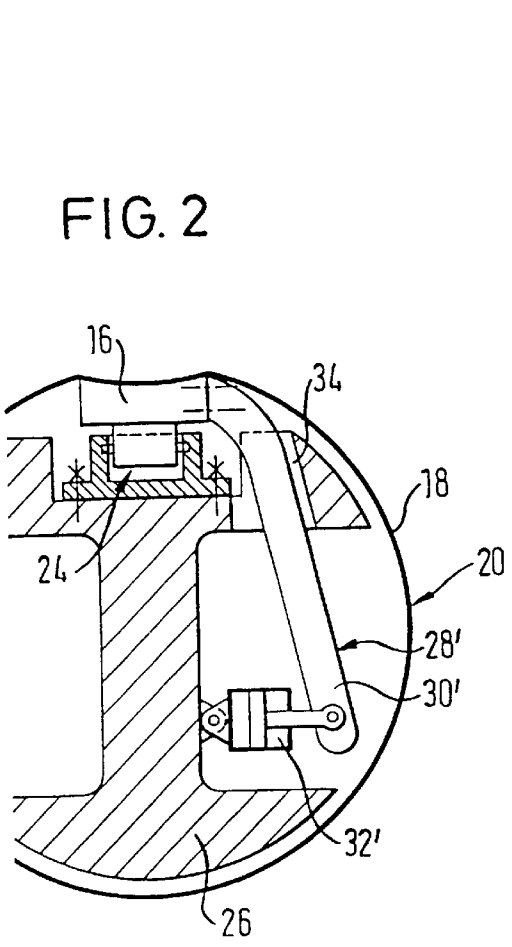
FIG. 2 is a schematic diagram of an additional embodiment of a press arrangement.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

Figure 1:
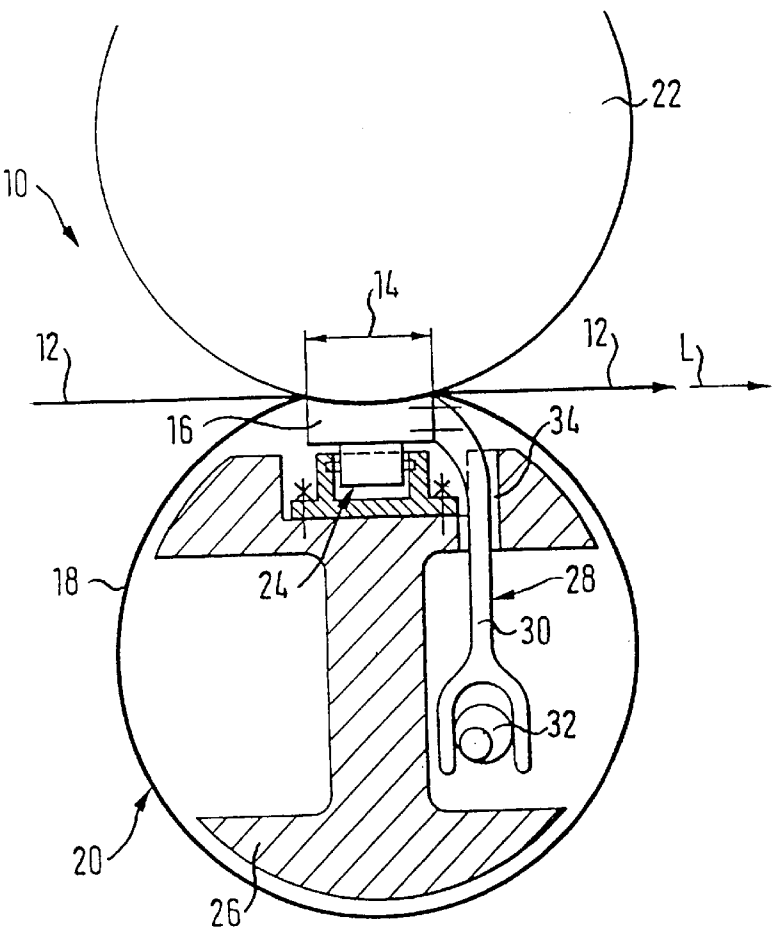
FIG. 1 is a schematic diagram of a press arrangement of a paper and cardboard machine.

FIG. 1 illustrates the press arrangement 10 of a paper or cardboard machine that treats a fibrous pulp sheet 12 in a press opening 14 that extends in the run direction L of the fibrous pulp sheet 12. In this case, the fibrous press sheet 12 is a paper and cardboard sheet. In accordance with one preferred embodiment of the invention, the press opening 14 is defined by a top and bottom press surface. The bottom press surface of the press opening 14 is defined by at least one flexible roller sleeve 18. The flexible roller sleeve is guided over at least one press shoe 16. The press shoe is part of a bottom press roller 20.

The top part of the press opening 14 is defined by a stiff roller sleeve of the cylindrical mating roller 22. The cylindrical mating roller 22 is positioned opposite to the bottom press roller 20. It would be obvious to one skilled in the art to have the top part of the press opening 14 defined similarly to the bottom part of the press opening of the previously discussed embodiment. Thus, the top part of the press opening 14 could be defined by a flexible roller sleeve that is guided over at least one press shoe.

The press shoe 16 is able to press the flexible press sleeve 18 of the bottom press roller 20 against the opposing surface which is created by the mating roller 22, creating a fluid cushion between the press shoe 16 and the press sleeve 18.

The press shoe 16 can be forced against the mating roller 20 with the assistance of a number of pressure units 24. The pressure units 24 can be one of several types, including several cylinder-piston units that are positioned under the press shoe 16 and supported by the stationary support 26. The flexible press sleeve 18 circulates around the stationary support 26.

The pressure units 24, constructed of cylinder-piston units, stress the press shoe 16 resulting in a main press force directed essentially perpendicular to the fibrous pulp sheet 12 that is being guided through the press opening 14.

In addition, several different devices 28 may be designed to load the press shoe 16 with either additional positive or negative forces that act on the press shoe 16. The additional positive or negative forces are directed substantially perpendicular to the resulting main press force, causing the press shoe 16 to tilt around the respective tilting axis. The tilting axis of the press shoe 16 extends substantially perpendicular to the run direction L of the fibrous paper sheet 12 in the transverse direction of the press arrangement 10. Thus, the press shoe 16 can perform small tilting movements.

An example of one type of device 28 that is designed to load the press shoe 16 with either the additional positive or negative force is shown in FIG. 1. In this embodiment of the invention, the device 28 consists of a number of units that are spaced across the press arrangement 10 and positioned perpendicular to the run direction L of the fibrous pulp sheet 12.

Each unit of device 28 shown in FIG. 1 includes a lever 30, which is connected to the press shoe 16 and which is able to transfer the additional positive or negative force to the press shoe 16. In the illustrated embodiment, the lever 30 is mounted on the right side of the press shoe 16.

The lever 30 usually extends downward, in a direction that is substantially perpendicular to the run direction L of the fibrous pulp sheet 12 and that is parallel to the resulting main press force.

Each unit of device 28 further includes a force unit that creates the positive or negative force that is loaded upon the press shoe 16. According to one embodiment of the invention, as shown in FIG. 1, the device 28 filther includes an eccentric shaft 32 as the force unit that may exert a force on the bottom end of the lever 30. The force is directed substantially parallel to the run direction L of the fibrous pulp sheet 12.

As shown in FIG. 1, the free bottom end of the lever 30 is constructed in a fork-shaped manner, with two prongs. The eccentric shaft 32 is positioned to engage the bottom end of the lever 30 within the two prongs of the fork-shaped aspect of the lever 30. As FIG. 1 shows, this arrangement is designed to permit the eccentric shaft 32 to selectively maneuver the lever 30 in one of two opposing directions. Each opposing direction is substantially parallel to the run direction L of the fibrous pulp sheet 12. The direction in which the lever 30 is maneuvered depends upon the angle positioning or the rotational direction of the eccentric shaft 32.

The fork shape of the free bottom end of the lever 30 extends downward, in a direction that is both essentially perpendicular to the run direction L of the fibrous pulp sheet 12 and essentially parallel to the resulting main press force. Thus, the respective shifting of the press shoe 16 that is caused by the resulting main press force is executed with the least amount of resistance.

As shown in FIG. 1, the devices 28 for the additional loading of the press shoe 16, include a lever 30 and an eccentric shaft 32 arranged within the flexible press sleeve 18. The flexible press sleeve 18 is the roller sleeve of the press roller 20, thus, the devices 28 are positioned inside the press roller 20.

It is obvious to one skilled in the art that the eccentric shaft 32 could be driven by using several different devices. For example, the eccentric shaft 32 could be driven by a motor that is adjustable via a self-locking gear assembly. Alternatively, the eccentric shaft 32 could be driven by forces that occur exterior to the press roller 20.

In accordance with another feature of the present invention, the lever 30 may be made correspondingly thin so that it achieves flexibility. Further, the lever 30 may be made from an elastic material to achieve flexibility.

As shown in FIG. 1 and FIG. 2, the press roller 20 further includes a stationary support 26. The top section of the stationary support 26 is equipped with an opening passage 34 through which the lever 30 or 30' can be threaded.

The press shoe 16 may be tensioned with the aid of the pressure units 24 that create a resulting main press force. The resulting main press force extends essentially perpendicular to the fibrous pulp sheet 12 that is being guided through the press opening 14. It is, however, possible for the pressure profile, set in the press opening 14 along the run direction L of the fibrous pulp sheet 12, to be influenced by a force that is independent of the resulting main press force caused by the respective devices 28. Thus, the force that causes the press shoe 16 to tilt can be independent from the main press force.

Preferably, the lever 30 is detachably mounted to the press shoe 16. Thus, the devices 28, which are designed for the additional loading of the press shoe 16, can be easily assembled and dismantled. To accomplish the assembly of the devices 28, only the lever 30 must be mounted to the press shoe 16 and the eccentric shaft 32 inserted. The dismantling of the devices can be accomplished with corresponding ease.

A second embodiment of the present invention is depicted in FIG. 2, which is a diagram of a bottom press roller 20 of a press arrangement 10. The primary difference between the embodiment shown in FIG. 1 and the embodiment shown in FIG. 2 is the different device 28'. In FIG. 2, the device 28' that includes a force unit that provides the additional loading of the press shoe 16 further includes a double-action piston-cylinder unit 32', which is designed to load the lever 30'. The bottom end of the lever 30' extends downward from the press shoe 16 at an angle. In accordance with one feature of the present invention, the double-action piston-cylinder unit 32' may be attached to the bottom end of the lever 30 and may also be attached to the stationary support 26. The flexible press sleeve 18, which serves as the roller sleeve for the bottom press roller 20, circulates around the stationary support 26.

According to another feature of the present invention, the lever 30' is constructed to be somewhat stronger than the lever 30 described in FIG. 1. The required elasticity results mainly from the piston-cylinder unit 32' that makes up the force unit.

Figure 3:
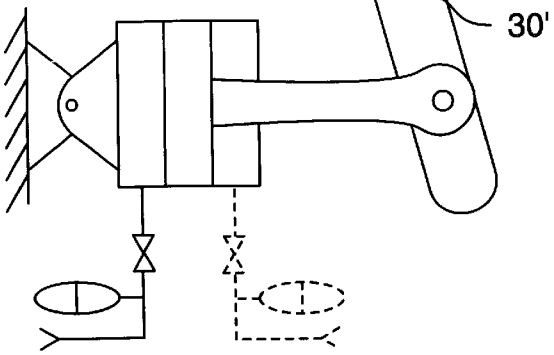
FIG. 3 is a schematic diagram of an alternative device for loading the press shoe in the run direction.

According to yet another feature of the present invention, as shown in FIG. 3, a gas accumulator may be positioned before or after this cylinder-piston unit 32', causing an increase in the overall elasticity of the arrangement. In such a case a damper may be positioned between the cylinder and the gas accumulator to dampen the throttle effect.

A corresponding shift of the press shoe 16, caused by the resulting main press force, occurs with relative ease because the cylinder-piston unit 32' that is assigned to be the force unit for the lever 30' is coupled with both the lever 30' and the stationary support 26.

Other than the devices 28', FIG. 2 displays an essentially identical design to that displayed in FIG. 1. Thus, discussion additional to that provided with respect to FIG. 1 is not necessary here, as the same reference numbers assigned to the corresponding parts in FIG. 2.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above.

Various changes can be made therein without departing from the spirit and scope of the invention.

Figure 4:
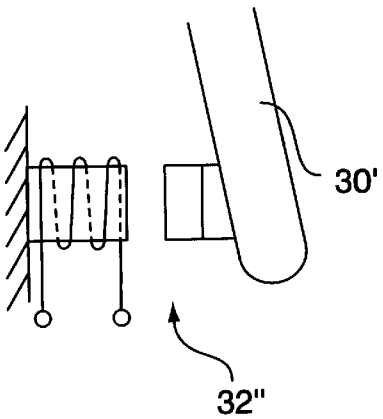
FIG. 4 is a schematic diagram of another alternative device for loading the press shoe in the FIGS. 5A and 5B are schematic diagrams of still other alternative devices for loading the press shoe in the run direction which is located outside of the roll.
Figure 5B:
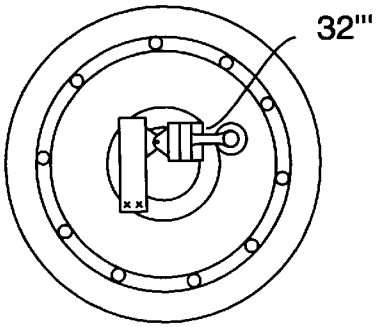
Figure 5A:
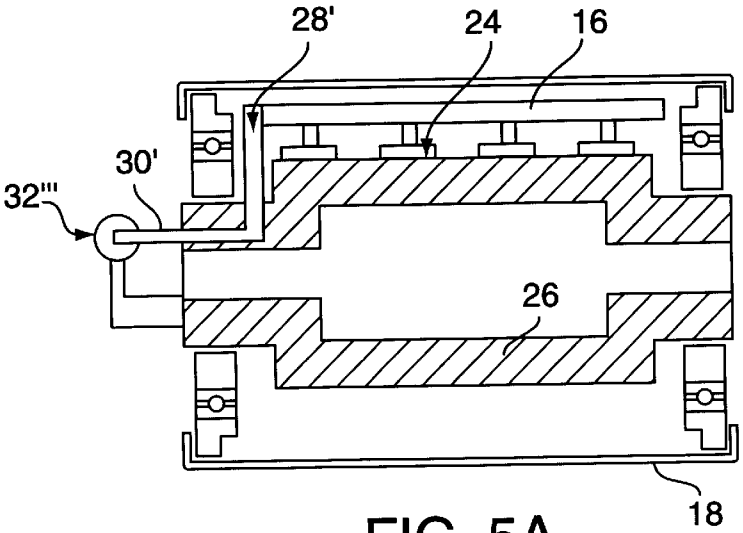

For example, the force unit that is assigned to the lever 30, 30', can, instead of a eccentric shaft or cylinder-piston unit, be designed as any other known force unit. It is possible, for example, to use a spring bellows, or an air bellows, or a magnetic unit, as shown in FIG. 4 as 32", and/or other similar devices known in the art for this purpose. Further, the force unit, as shown in FIGS. 5A and 5B, may be located outside of the roll body as 32'".

What is claimed is:

1. A press arrangement of a paper or cardboard machine to treat a fibrous pulp sheet including:

a press opening extending in a run direction of the fibrous pulp sheet and defined by two press surfaces;

at least one press shoe;

at least one of said tvo press surfaces comprises a flexible press sleeve guided over said at least one press shoe;

a device exerting a resulting main press force on said at least one press shoe in a direction substantially perpendicular to said run direction; and a device loading said at least one press shoe with one of a positive and negative force acting substantially perpendicular to said resulting main press force and transferring a tilting moment to said press shoe; and said press shoe being tiltable around a tilting axis extending substantially perpendicular to said run direction and in a transverse direction of said press arrangement, the loading device comprising at least one lever coupled to the at least one press shoe.

wherein said one of a positive and negative force essentially independently influences a pressure profile in said press opening set along the run direction of said fibrous pulp sheet.

2. A press arrangement according to claim 1, wherein said at least one lever is adapted to transfer said one of said positive or negative forces to said press shoe.

3. A press arrangement according to claim 2, wherein said lever extends substantially perpendicular to said run direction of said fibrous pulp sheet and essentially parallel to said resulting main press force.

4. A press arrangement according to claim 2 wherein said lever is designed to be thin such that said lever is elastic.

5. A press arrangement according to claim 2 wherein said lever is designed from an elastic material whereby said lever is elastic.

6. A press arrangement according to claim 1, wherein said devices for said loading comprise:

a plurality of force units, spaced across said press arrangement and positioned perpendicular to said run direction of said fibrous pulp sheet, whereby said press shoe can be stressed over a width of said press arrangement and whereby said force units influence said pressure profile of said press shoe.

7. A press arrangement according to claim 6, wherein said individual force units stress said press shoe in an assigned zone whereby said assigned zones combine to have a cumulative effect on said pressure profile.

8. A press arrangement according to claim 6 wherein each of said force units spaced across said press arrangement further includes said at least one said lever and at least one said force unit assigned to said lever.

9. A press arrangement according to claim 7 wherein each of said units spaced across said press arrangement further includes said at least one said lever and at least one said force unit assigned to said lever.

10. A press arrangement of a paper or cardboard machine to treat a fibrous pulp sheet comprising:

a press opening extending in a run direction of the fibrous pulp sheet and defined by two press surfaces;

at least one press shoe;

at least one of said two press surfaces comprises a flexible press sleeve guided over said at least one press shoe;

a device exerting a resulting main press force on said at least one press shoe in a direction substantially perpendicular to said run direction;

a device loading said at least one press shoe with one of a positive and negative force acting substantially perpendicular to said resulting main press force and transferring a tilting moment to said press shoe; and said press shoe being tiltable around a tilting axis extending substantially perpendicular to said run direction and in a transverse direction of said press arrangement, wherein said one of a positive and negative force essentially independently influences a pressure profile in said press opening set along the run direction of said fibrous pulp sheet, wherein said device further includes at least one lever connected to said press shoe to transfer said one of said positive or negative forces to said press shoe;

further including a force unit to maneuver an end of said lever, said end faces away from said press shoe, whereby said force unit maneuvers said end of said lever in either of two opposing directions, said directions being essentially parallel to said run direction of said fibrous pulp sheet, thereby creating said one of said positive and negative pressure on said press shoe.

11. A press arrangement according to claim 10, wherein said force unit acts on said lever and is supported to enable tilting of said press shoe, caused by the resulting main pressure force.

12. A press arrangement according to claim 10, wherein said force unit assigned to said lever includes at least one spring bellows.

13. A press arrangement according to claim 10, wherein said force unit assigned to said lever includes at least one magnetic unit.

14. A press arrangement according to claim 10, wherein said lever and said force unit assigned to said lever are placed within said flexible press sleeve of a press roller and within said press roller.

15. A press arrangement according to claim 14, wherein said press roller further includes a stationary support located within said press roller and around which said flexible press sleeve circulates, whereby said force unit assigned to said lever and said pressure unit for stressing said press shoe and creating said main press force that is essentially perpendicular to said run direction of said fibrous paper sheet are supported by said stationary support.

16. A press arrangement according to claim 15, wherein said force unit assigned to said lever includes said cylinder-piston unit whereby said cylinder-piston unit is connected to said lever and to said stationary support whereby said press shoe shifts as a result of said main press force.

17. A press arrangement according to claim 10, wherein said force unit assigned to said lever includes at least one hydraulic or pneumatic cylinder-piston unit.

18. A press arrangement according to claim 17, wherein at least one said force unit assigned to said lever includes at least one double action cylinder-piston unit.

19. A press arrangement according to claim 18 wherein at least one said double action cylinder-piston unit further includes:

a preceding or trailing gas accumulator;

at least one damper dampening a throttle effect, whereby said damper is positioned between said double action cylinder-piston unit and said gas accumulator.

20. A press arrangement according to claim 17 wherein at least one said hydraulic or said pneumatic cylinder-piston unit further includes:

a preceding or trailing gas accumulator;

at least one damper dampening a throttle effect, whereby said damper is positioned between said hydraulic or said pneumatic cylinder piston unit and said gas accumulator.

21. A press arrangement according to claim 10, wherein said force unit assigned to said lever includes an eccentric cam or an eccentric shaft.

22. A press arrangement according to claim 21, wherein said eccentric cam or said eccentric shaft selectively maneuvers said lever in one of two opposing directions, whereby said direction depends on the angle positioning or the rotational direction of said eccentric cam or eccentric shaft.

23. A press arrangement according to claim 21 wherein said eccentric cam or eccentric shaft further includes a driver for driving said eccentric cam or said eccentric shaft, said driver comprising a motor with a self-locking gear assembly.

24. A press arrangement according to claim 23, wherein said driver driving said eccentric cam or said eccentric shaft is located inside a press roller.

25. A press arrangement according to claim 21, wherein said free end of said lever is fork-shaped and said eccentric cam or eccentric shaft engages said fork-shaped free end of said lever.

26. A press arrangement according to claim 25, wherein said fork-shaped end of said lever extends essentially perpendicular to said run direction of said fibrous pulp sheet and parallel to said resulting main press force, whereby said press shoe is shifted by said resulting main press force with little obstruction.

27. A press arrangement according to claim 10, wherein said force unit assigned to said lever includes at least one air bellow.

28. A press arrangement to be used in a paper or cardboard machine that includes:

a press opening wherein a fibrous pulp sheet is treated and guided in a run direction, said press opening extending in said run direction of said fibrous pulp;

a first press roller including a first press surface, said first press surface including a flexible press sleeve;

a second press roller including a second press surface, whereby said first and second press surfaces define said press opening;

a press shoe pressing said first press surface whereby said first press surface is guided over said press shoe and presses said second press surface, whereby said press shoe is stressed such that a resulting main press force is exerted in a direction that is substantially perpendicular to said fibrous pulp sheet guided through said press opening;

a pressure unit pressing said press shoe;

a device loading said press shoe with one of a positive and negative force, transferring a tilting moment to said press shoe thereby tilting said press shoe around a tilting axis extending substantially perpendicular to said run direction of said fibrous pulp sheet, said positive or negative force acting substantially independently of, and perpendicular, to said main press force, the loading device comprising at least one lever coupled to the press shoe.

29. A press arrangement according to claim 28, wherein said device further comprises:

said at least one lever extending substantially perpendicular to said run direction of said fibrous pulp sheet; and at least one force unit being assigned to said lever, whereby said lever transfers said one of said positive and negative force to said press shoe.

30. A press arrangement according to claim 29 wherein said force unit is selected from the group consisting of spring bellows, air bellows, magnetic unit, hydraulic cylinder-piston unit, pneumatic cylinder-piston unit, double action cylinder-piston unit, eccentric cam and eccentric shaft.

31. A press arrangement to be used in a paper or cardboard machine comprising:

a press opening wherein a fibrous pulp sheet is treated and guided in a run direction, said press opening extending in said run direction of said fibrous pulp;

a first press roller including a first press surface, said first press surface including a flexible press sleeve;

a second press roller including a second press surface, whereby said first and second press surfaces define said press opening;

a press shoe pressing said first press surface whereby said first press surface is guided over said press shoe and presses said second press surface, whereby said press shoe is stressed such that a resulting main press force is exerted in a direction that is substantially perpendicular to said fibrous pulp sheet guided through said press opening;

a pressure unit pressing said press shoe;

a device loading said press shoe with one of a positive and negative force, transferring a tilting moment to said press shoe thereby tilting said press shoe around a tilting axis extending substantially perpendicular to said run direction of said fibrous pulp sheet, said positive or negative force acting substantially independently of, and perpendicular to, said main press force;

at least one lever extending substantially perpendicular to said run direction of said fibrous pulp sheet, said lever connected to said press shoe; and at least one force unit assigned to said lever whereby said lever transfers said one of said positive and negative force to said press shoe, wherein said force unit maneuvers an end of said lever in one of two directions substantially parallel to said run direction of said fibrous pulp sheet, thereby creating one of said positive and negative force on said press shoe, said positive or negative force acting on said press shoe substantially perpendicular to said main press force.

32. A press arrangement according to claim 31 wherein said force unit is positioned within said first press roller.

33. A press arrangement according to claim 31 wherein said force unit is positioned outside said first press roller.

34. A press arrangement of a paper or cardboard machine to treat a fibrous pulp sheet comprising:

a press nip structured and arranged to extend in a run direction of the fibrous pulp sheet and being defined by two press surfaces;

at least one press shoe;

at least one of said two press surfaces comprises a flexible press sleeve guided over said at least one press shoe;

a force device structured and arranged to exert a resulting main press force on said at least one press shoe in a direction perpendicular to said run direction;

a load device structured and arranged to load said at least one press shoe with one of a positive and negative force parallel to the run direction, whereby a tilting moment is transferred to said press shoe, and said press shoe being tiltable around a tilting axis transverse to said run direction; and said load device comprising at least one lever coupled to the at least one press shoe to adjustably position the at least one press shoe in one of in and against the run direction.

35. A press arrangement to be used in a paper or cardboard machine comprising:

a press nip structured and arrange to treat and guide a fibrous pulp sheet in a run direction, said press nip extending in said run direction of said fibrous pulp;

a first press roll including a first press surface, said first press surface including a flexible press sleeve;

a second press roll including a second press surface, whereby said first and second press surfaces define said press opening;

a press shoe structured and arranged to press said first press surface, whereby said first press surface is guidable over said press shoe to press against said second press surface, and whereby said press shoe is structured and arranged to exert a resulting main press force in said press nip perpendicular to said fibrous pulp sheet;

a pressure unit structured and arranged to press said press shoe;

a device structured and arranged to load said press shoe with one of a positive and negative force, whereby a tilting moment is transferred to said press shoe to tilt said press shoe around a tilting axis extending perpendicular to said run direction of said fibrous pulp sheet, said one of a positive and negative force being directed in one of in and against the run direction of the fibrous sheet; and the load device comprising at least one lever coupled to the at least one press shoe to adjustably position the at least one press shoe in the one of in and against the run direction.

* * * * *